US012796867B2

(12) United States Patent
Seckinger

(10) Patent No.: US 12,796,867 B2
(45) Date of Patent: Nov. 17, 2026

(54) BATH COVER FOR A CHILD

(71) Applicant: Luve, LLC, Phoenix, AZ (US)

(72) Inventor: Amy Seckinger, Phoenix, AZ (US)

(73) Assignee: LUVE, LLC, Phoenix, AZ (US)

( * ) Notice: Subject to any disclaimer, the term of this patent is extended or adjusted under 35 U.S.C. 154(b) by 145 days.

(21) Appl. No.: 18/629,694

(22) Filed: Apr. 8, 2024

(65) Prior Publication Data

US 2024/0335068 A1 Oct. 10, 2024

Related U.S. Application Data

(60) Continuation of application No. 16/579,773, filed on Sep. 23, 2019, now Pat. No. 11,980,326, which is a division of application No. 15/287,169, filed on Oct. 6, 2016, now Pat. No. 10,595,681, which is a continuation of application No. 11/774,475, filed on Jul. 6, 2007, now abandoned.

(60) Provisional application No. 60/819,216, filed on Jul. 7, 2006.

(51) Int. Cl.
*A41B 13/00* (2006.01)
*A47K 3/00* (2006.01)

(52) U.S. Cl.
CPC ..... *A47K 3/001* (2013.01); *A41B 13/00* (2013.01)

(58) Field of Classification Search
CPC ..... A41B 13/10; A41B 13/00
USPC ..... 2/111
See application file for complete search history.

(56) References Cited

U.S. PATENT DOCUMENTS 2,622,246 A * 12/1952 Hufnagel ..... A41B 13/10 2/49.1
3,879,762 A * 4/1975 Herman ..... A41B 13/10 2/48
3,979,776 A * 9/1976 Gruenwald ..... A41B 13/10 24/1
4,525,875 A * 7/1985 Tomczak ..... A41D 13/0518 2/466
5,490,289 A * 2/1996 Lehrer ..... A41B 13/103 2/49.4
5,802,610 A * 9/1998 Burr ..... A41B 13/10 2/49.4
RE38,393 E * 1/2004 Bronson ..... A41B 13/10 2/102
2003/0014801 A1* 1/2003 Mohney ..... A41B 13/10 2/48
2003/0213042 A1* 11/2003 McCloskey ..... A41B 13/10 2/49.1
2004/0194187 A1* 10/2004 Mayr ..... A41D 7/006 2/88

* cited by examiner

*Primary Examiner* — Timothy K Trieu
(74) *Attorney, Agent, or Firm* — SNELL & WILMER L.L.P.

(57) ABSTRACT

A bath cover for comforting a child during a bathing process includes a body portion at least partially formed of a reusable absorbent material and configured to cover at least a portion of the torso of the child. The body portion has an upper end with a contour corresponding to the neck of the child. The bath cover also includes first and second support portions extending outwardly at the upper end of the body and positionable over the shoulders of the child. The relatively absorbent material is configured to be wetted and positioned adjacent to the child to warm the child during the bathing process.

18 Claims, 9 Drawing Sheets

BATH COVER FOR A CHILD

CROSS-REFERENCE TO RELATED APPLICATIONS

This application is a continuation of and claims priority to U.S. patent application Ser. No. 16/579,773, filed Sep. 23, 2019, entitled, "Bath Cover for a Child," which is a divisional of and claims priority to U.S. patent application Ser. No. 15/287,169, filed Oct. 6, 2016, entitled, "Bath Cover for a Child" (U.S. Pat. No. 10,595,681 issued Mar. 24, 2020), which is a continuation of and claims priority to U.S. patent application Ser. No. 11/774,475, filed on Jul. 6, 2007, now abandoned, which claims priority to U.S. Provisional Application Ser. No. 60/819,216, having a filing date of Jul. 7, 2006. The disclosures of all applications listed above are incorporated herein by reference in their entireties.

FIELD

The present disclosure relates generally to covers for children, and more particularly to bath covers for children.

BACKGROUND

The present disclosure relates generally to systems for (e.g., bath accessories, etc.) and methods of bathing an infant, toddler, and/or adolescent (collectively referred to for purposes of the present disclosure as a child). More particularly, the present disclosure relates to systems for and methods of covering a portion of the child to warm, comfort or otherwise shield the child during a bathing process.

The process of bathing a child can be a pleasurable experience for the child due to the warmth and comfort of a well-arranged bath. Unfortunately, the process of bathing a child can also be a time of great anxiety, tension, and/or discomfort for the child. Such discomfort often results when the child is subjected to a sudden change in temperature, such as the temperature difference between the relatively warm bath water and the relatively cool ambient air.

In situations where the entire body of the child is substantially submersed within the bath water (except for the head of the child), the child is unlikely to notice the temperature difference between the bath water and the ambient air until it is time to get out of the bath (at which time the child may be wrapped in a dry towel to comfort the child). However, in situations where a significant portion of the child is exposed to the ambient air during the bath process while another portion is submersed within the bath water, the child is more likely to experience discomfort due to the temperature difference. Such discomfort may cause the child to cry or whine.

While it may be pleasurable for a child to be substantially submersed within a warm bath, such a position may not be reasonably practical for the parent or caretaker giving the child the bath. Parents and caretakers bathing a child often must use one hand to wash and rinse the child and the other hand to control the position of the child. Due to the slippery nature of administering a bath, there exists the potential for an accidental submersion of the head or face of the child. Using less water in the bath tub may reduce the likelihood of an accidental submersion. However, this results in having a substantial portion of the child exposed to ambient air during the bath process.

Various devices and bath tub assemblies have been introduced which are designed specifically to support and comfort a child during the bath process. These devices include pads, adjustable platforms, slings, or hammocks. Each device is configured to prop a child up and protect against accidental submersions of the head or face of the child. Unfortunately, the trade off with these devices and bath tub assemblies is that a portion of the child is exposed to the ambient air during the bathing process. For example, it is not uncommon for a substantial portion of the torso (e.g., chest, abdominal area, etc.) of the child to be exposed to the ambient air during the bathing process.

Thus, there is a need for a bath accessory for and method of covering a portion of a child undergoing a bath process that would otherwise be exposed to the relatively cool ambient air. There is also a need for a bath accessory for and method of covering a portion of a child that is suitable for use with a small child (e.g., infant, toddler, etc.). There is further a need for a bath accessory for and method of covering a portion of a child during a bath process. There is further a need for a bath accessory in the form of a bath cover that can be readily used to cover the child during the bathing process. There is further a need for a bath accessory and/or a bath cover addressing these and/or any other need.

SUMMARY

In general, one aspect of the subject matter described in this disclosure may be embodied in a bath accessory for a child. The bath accessory includes a main portion formed of a relatively absorbent and soft material. The main portion is sized to cover a substantial portion of the torso of the child. The main portion defines an aperture (e.g., cutout portion, depression, etc.) configured to substantially conform to and be supported adjacent to the neck of the child. The bath accessory also includes a first support member and a second support member. The first and second support members are supported at the upper end of the main portion and are configured to drape over the shoulders of the child (one support member on each shoulder). The main portion is configured to receive and hold warm water in an attempt to comfort the child.

The present disclosure provides, in another aspect, a bath cover for use on a child during a bathing process. The bath cover includes a main portion formed of a relatively absorbent material and configured to at least partially cover the torso of the child, first and second support members supported at an upper portion of the main portion and configured to drape over the shoulders of the child for securing the bath cover to the child, and a gonadic portion supported at a lower portion of the main portion. The main portion, the first and second support members, and the gonadic portion are integrally formed to provide a one-piece unitary cover. The cover is configured to be placed upon the child during the bathing process to warm the child.

The present disclosure provides, in yet another aspect, a method of comforting a child during a bathing procedure involving a tub. The method includes the steps of dampening an absorbent cloth with water and placing the cloth over the torso of the child while the child is in the tub. The cloth includes a main portion and a support portion. The main portion is sized to substantially cover the torso of the child and includes an upper end having a contoured region configured to be supported adjacent to the neck of the child. The support portion includes a pair of support legs outwardly extending from the upper end, each support leg is configured to be positioned at a respective shoulder of the child. The method further includes the steps of positioning the main portion of the cloth over the torso of the child, positioning the contoured region adjacent to the neck of the child, and positioning each support leg at a respective shoulder of the child. The main portion of the cloth is at least partially maintained over the torso of the child by the pair of support legs interacting with the shoulders of the child.

Other features and aspects of the disclosure will become apparent by consideration of the following detailed description and accompanying drawings.

Figure 1:
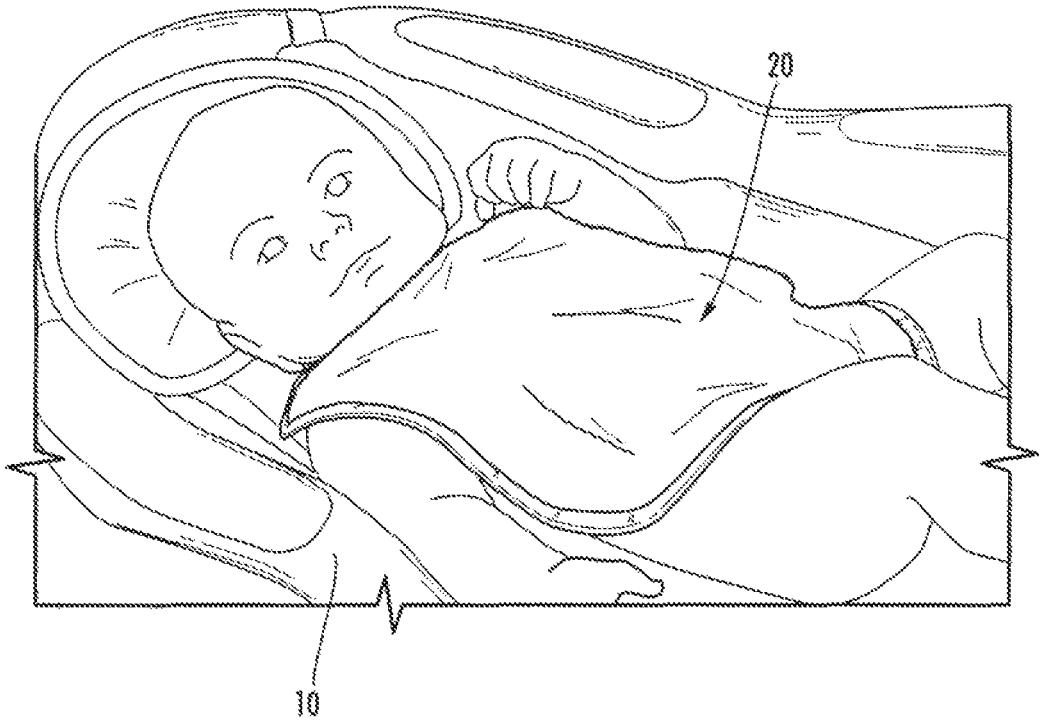
FIG. 1 is a perspective view of a bath cover according to an exemplary embodiment and shown being used with a child.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Referring generally to the Figures, a bath cover and components thereof are shown according to exemplary embodiments. The bath cover (e.g., towel, cloth, drape, etc.), shown as a bath cover 20, is configured to warm or otherwise comfort a person (e.g., child, etc.) being bathed. Bath cover 20 is formed of a relatively soft and flexible (e.g., conformable, pliable, etc.) material and generally comprises a main body portion and one or more support portions. The main body portion of bath cover 20 is configured to at least partially cover a portion of the person that would otherwise be exposed to ambient air during the bathing process, while the one or more support portions are intended to assist in maintaining and/or securing the main body portion in its desired position on the person. Use of bath cover 20 is intended to eliminate or at least reduce any discomfort (e.g., chill, uneasiness, etc.) that a person may experience when a first portion of the person is submersed in relatively warm water and a second portion of the person is exposed to the relatively cool ambient air (i.e., a typical occurrence when bathing a child).

According to one exemplary embodiment, at least the main body portion of bath cover 20 is formed of a relatively absorbent material. Using a relatively absorbent material allows the main body portion to be saturated or otherwise dampened with water (either from the bath tub or a secondary source) to further assist in warming the person undergoing the bathing process.

Before discussing the details of the bath cover, and specifically bath cover 20, it should be noted at the outset that references to "front," "back," "rear," "upper," "lower," "right," and "left" in this description are merely used to identify the various elements as they are oriented in the Figures. These terms are not meant to limit the element which they describe, as the various elements may be oriented differently in various applications.

It should also be noted that for purposes of this disclosure, the term "coupled" means the joining or combining of two members (e.g., portions, layers, materials, components, etc.) directly or indirectly to one another. Such joining or combining may be stationary (e.g., fixed, etc.) in nature and/or moveable (e.g., adjustable, etc.) in nature. Such joining or combining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It should further be noted that while the exemplary embodiments of the bath cover are described and illustrated herein as a bath towel for covering a portion of the torso of a person while bathing (e.g., the chest, abdominal region, back, sides, etc.), and more particularly, as a bath towel for covering a portion of the torso of a person who is an infant, toddler, child, and/or adolescent (collectively referred to for purposes of the present disclosure as a "child"), the bath cover may also be configured to cover other areas of the child. For example, the bath cover may be configured to at least partially cover the head and/or extremity regions of a child, and/or any other area of the child that may benefit from being covered during the bathing process. Further, the bath cover may also be sized and configured to be used with persons other than children (e.g., adults).

Also, bath cover 20 may be used regardless of the position of the child. For example, the child may be provided in a supine position wherein the child is positioned on his or her back with the legs of the child being straight or bent, a seated position wherein the child is positioned with his or her legs substantially perpendicular to his or her back, and/or a lateral position wherein the child is positioned on one side.

Figure 2:
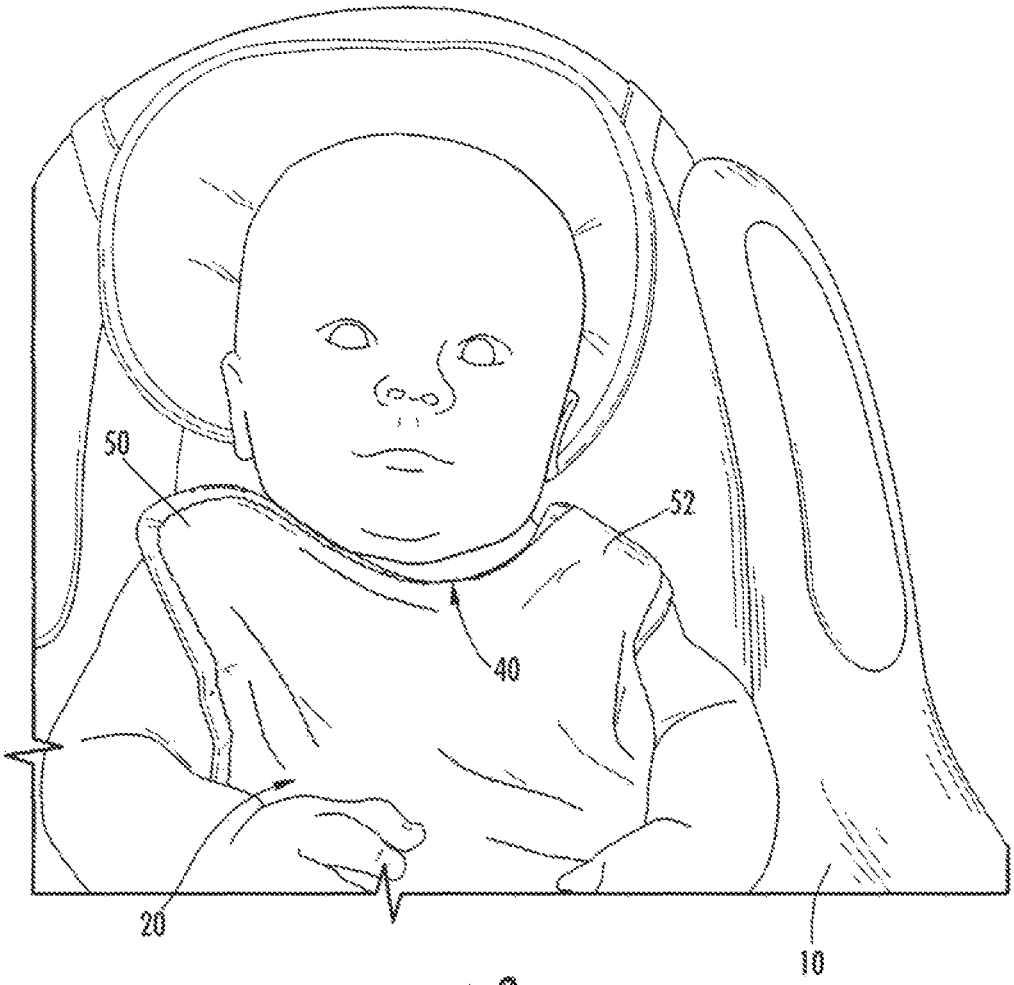
FIG. 2 is another perspective view of the bath cover illustrated in FIG. 1.

Referring initially to FIGS. 1 through 5, bath cover 20 is illustrated according to an exemplary embodiment. Referring to FIGS. 1 and 2 in particular, bath cover 20 is shown as being draped over a child placed within a water-retaining device (shown as a bath tub 10). Bath tub 10 is in the form of an elongated-shaped basin dimensioned to receive a child and configured to retain water. Bath tub 10 facilitates the immersion, bathing, and rinsing of the child while at least a portion of the child remains above the water level and exposed to the ambient air. The child is facing upward with his or her head at one of the tub and his or her feet at an opposite end. It should be noted that bath 10 is shown for illustrative purposes only and is not intended to be limiting. Bath cover 20 is suitable for use with any known or otherwise suitable water-retaining devices for bathing children. For example, bath cover 20 is suitable for use with a water-retaining device configured to receive a sling or hammock which secures or otherwise supports a child during the bathing process.

Figure 3:
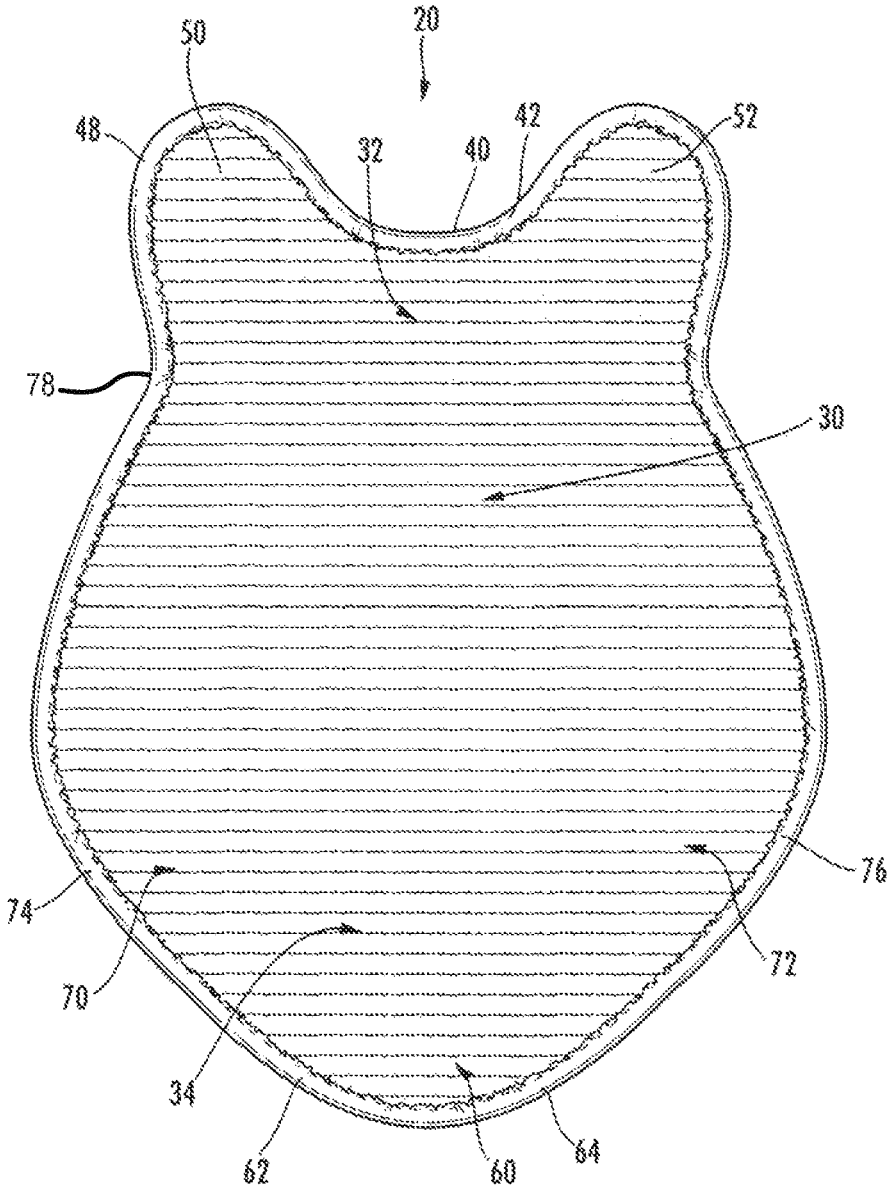
FIG. 3 is top view of the bath cover illustrated in FIG. 1.
Figure 4:
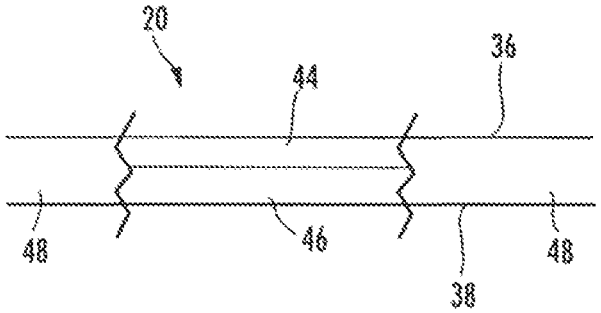
FIG. 4 is cutaway side view of the bath cover illustrated in FIG. 1.

FIG. 3 is a front view showing bath cover 20 in a relatively flattened or extended position. Bath cover 20 generally comprises a body portion (e.g., base, cover, central region, etc.), shown as a main portion 30 and support portion (e.g., retaining device, etc.), shown as a first support leg 50 and a second support leg 52. Main portion 30 is configured to at least partially cover the torso of a child (i.e., the portion of the child that would otherwise be exposed to the ambient air during the bathing process), while first support leg 50 and second support leg 52 are intended to assist in maintaining and/or securing main portion 30 in its desired position on the child. First support leg 50 and second support leg 52 are shown as being integrally formed with main portion 30 to provide a one-piece unitary cover. According to various alternative embodiments, first support leg 50 and second support leg 52 may be formed separately from main portion 30 and subsequently coupled thereto via any suitable fastening technique (e.g., stitching, thermal bonding, adhesive, mechanical fastener, etc.).

Main portion 30 is shown as a substantially rectangular member having a first or upper portion, shown as a top region 32, a second or lower portion, shown as a bottom region 34, a third or front portion, shown as a front surface 36, and a fourth or rear portion, shown as a rear surface 38. Rear surface 38 is intended to be placed against the skin of the child with top region 32 being positioned adjacent to (e.g., proximate, near, at, etc.) the neck of a child. Top region 32 includes a configuration (e.g., shape, profile, etc.) suitable for allowing bath cover 20 to receive or substantially conform to (e.g., wrap around, etc.) the contours of the neck of the child.

According to an exemplary embodiment, top region 32 is shown as having a cutout or missing portion (e.g., concave region, curvature, etc.), shown as a depression 40, that is shaped and dimensioned to substantially conform to the contours of the neck of a child.

Depression 40 is defined by an edge 42 having a curvilinear shape (e.g., arcuate, semi-circular, etc.). The size and shape of depression 40 may vary depending on a number of design criteria. For example, depression 40 may be sufficiently sized and shaped to receive and/or accommodate a typical neck size range for children of a particular age (e.g., 0-6 months, 6-12 months, 12-18 months, 18-24 months, etc.). According to various alternative embodiments, depression 40 may be sufficiently sized and shaped to accommodate a wide range of children or a specific type of child. For example, depression 40 may be sized and shaped to use with premature babies which are typically smaller than other babies. According to further alternative embodiments, the size and/or shape of depression 40 may be adjustable by a user (e.g., may have an elastic edge, may have an adjustable drawstring or strap, may have an adjustable fastener such as hook and loop fasteners sold as VELCRO®, buttons or the like, etc.). According to a still further alternative embodiments, depression 40 may have any of a variety of shapes, including shapes having linear portions, non-linear portions, or combinations thereof.

Main portion 30 is generally formed of one or more layers of relatively absorbent materials. The type of material used may vary depending on various design criteria (e.g., softness, durability, absorbency, color, texture, etc.). For example, main portion 30 may be formed of any suitably absorbent natural fibers or fabrics (e.g., cotton, silk, wool, hemp, etc.) and/or synthetic materials (e.g., acrylics, polyester, microfiber, nylon, rayon, etc.). Main portion 30 may also be formed of, at least in part, a material configured to absorb heat so that it can stay relatively warm during the entire bathing process. Anyone of the aforementioned materials alone or in a combination of two or more of the materials may be used to form main portion 30.

According to one exemplary embodiment, main portion 30 is formed of a cotton and/or silk fabric such as chenille, flannel, or terry cloth. It should be noted that the material used to form main portion 30 is not limited to the aforementioned materials, and according to various alternative embodiments may be formed of any known or otherwise suitable material.

According to an exemplary embodiment, the material used to form main portion 30 is generally light and flexible to maximize workability for conforming, bending, folding, etc., or otherwise manipulating. The material may be formable (e.g., deformable) or compliant, and/or relatively "stretchable" (e.g., elastic). Preferably, the material provides softness or comfort to the child, and is easily cleaned and/or sanitized (e.g., washable, etc.).

Main portion 30 can have a wide range of thickness, weights and/or densities depending upon the desired absorbency and/or other design criteria of bath cover 20. Main portion 30 can also include materials differing in color, patterns, textures, images, etc. According to the embodiment illustrated in FIG. 4, main portion 30 is formed of a first panel or material 44 for defining front surface 36 of main portion 30 and a second panel or material 46 for defining rear surface 38 of main portion 30. Surrounding a peripheral edge of first material 44 and second material 46 is a binding 48 (e.g., edging, etc.). Binding 48 may assist in securing first material 44 relative to second material 46 and/or may be provided for aesthetic purposes.

Supported at top region 32 of main portion 30 are first support leg 50 and second support leg 52. First support leg 50 and second support leg 52 are configured to assist in securing bath cover 20 in its desired position on the child. Without first support leg 50 and second support leg 52 (or an equivalent structure included within the scope of the present application), the parent or caretaker giving the bath would likely have to use one hand to keep the bath towel in place.

First support leg 50 and second support leg 52 upwardly extend from top region 32 of main portion 30 and are each defined at a periphery by a curvilinear edge. According to various alternative embodiment, first support leg 50 and second support leg 52 may have any of a number of shapes and sizes depending on the various design criteria (e.g., the size of the child, the likely position of the child, etc.).

First support leg 50 and second support leg 52 may be formed of the same or of a different material as main portion 30. According to an exemplary embodiment, first support leg 50 and second support leg 52 are formed of the same material as main portion 30. According to various alternative embodiments, first support leg 50 and second support leg 52 are formed of a slightly heavier or weighted material to assist in maintaining the legs on the shoulders of the child thereby allowing main portion 30 to remain at its desired position. To further assist in maintaining the desired position of bath cover 20 on the child, the rear surfaces of first support leg 50 and second support leg 52 may include a friction generating feature (e.g., small rubber projections, varying texture, etc.).

According to the embodiment illustrated, first support leg 50 and second support leg 52 are configured to extend substantially straight back over the shoulders of the child (i.e., substantially parallel to a longitudinal axis of main portion 30). More specifically, first support leg 50 and second support leg 52 are shown as extending slightly outward as they extend back over the shoulders of the child. Such a configuration is distinguishable over conventional baby bibs which typically include two extensions that are fastened behind the neck of the child.

Configuring first support leg 50 and second support leg 52 to rest on the shoulders of the child, without having their free ends coupled to one another, may allow bath cover 20 to be easily applied to and removed from the child. According to various alternative embodiments, the free ends of first support leg 50 and second support leg 52 may be coupled to each other or coupled to another structure (e.g., a bath tub, a sling or hammock within a bath tub, etc.) to assist in maintaining bath cover 20 in a desired position on the child.

According to the embodiment illustrated, first support leg 50 and second support leg 52 are integrally formed with main portion 30 to provide a one-piece unitary cover. According to various alternative embodiments, first support leg 50 and second support leg 52 may be formed as separate components and subsequently coupled to main portion 30. First support leg 50 and second support leg 52 may be coupled to main portion 30 by an adhesive (e.g., a heat or pressure sensitive adhesive, etc.), thermal bonding (e.g., sonic welding, etc.), stitching, mechanical fasteners (e.g., clips, grommets, hook and loop fasteners sold as VELCRO®, snaps, buttons, zippers, etc.), or a combination of techniques, or any other known or otherwise suitable technique.

Referring further to FIG. 3, bath cover 20 is further shown as generally comprising a member or portion (e.g., gonadic shield, extension, cover, etc.) intended to cover the gonadic area of the child. Such a portion, shown as a privacy flap 60, is supported at bottom region 34 of main portion 30. According to the embodiment illustrated, privacy flap 60 is integrally formed with main portion 30 to provide a one-piece unitary cover. According to various alternative embodiments, privacy flap 60 may be formed as a separate component and subsequently coupled to main portion 30 using techniques similar to those detailed above in relation to the support members.

According to an exemplary embodiment, the function of privacy flap 60 is twofold. First, privacy flap 60 is configured to further warm or otherwise comfort the child during the bath process by at least partially covering the gonadic area of the child (i.e., which may have heightened sensitivity). Second, privacy flap 60 is configured to control the disposition of urine in the event that the child is unable to control urination during the bathing process. Such a feature may be particularly desirable to the person giving the bath since the likelihood of uncontrolled urination by a child is particularly increased when the child is subjected to sudden temperature changes such as when an unclothed child is partially placed within a warm bath. Although privacy flap 60 may be particularly effective for a male child, privacy flap 60 is also effective for a female child.

The size and shape of privacy flap 60 can vary depending on various design criteria. According to the embodiment illustrated, privacy flap 60 is a convex portion downwardly extending from bottom region 34 of main portion 30. Privacy flap 60 is defined by a peripheral edge having a substantially continuous curvilinear shape. The peripheral edge includes first edge 62 configured to be positioned adjacent to an inner portion of the left leg of the child (e.g., upper left thigh, etc.) and a second edge 64 configured to be positioned adjacent to an inner portion of the right leg of the child (e.g., upper right thigh, etc.). While first edge 62 and second 64 are shown as extending in a substantially linear fashion at the locations where privacy flap 60 is likely to contact the legs of the child, according to alternative embodiments, these portions may include additional curved edges to further conform to the contours of the legs of the child.

According to an exemplary embodiment, privacy flap 60 is formed of the same material as main portion 30 and is configured to absorb urine in the event of uncontrolled urination. According to various alternative embodiments, privacy flap 60 may be formed of or at least include a different material than main portion 30. For example, it may be desirable to include a relatively non-absorbent material at an outer rear surface (i.e., the surface adjacent to the child) of privacy flap 60 intended to deflect the urine rather than absorb the urine. Such a configuration may prolong the usefulness of bath cover 20 before becoming soiled. According to another alternative embodiment, it may be desirable to form privacy flap 60 with a relatively absorbent material and to include a relatively non-absorbent barrier or membrane between main portion 30 and privacy flap 60. Such a barrier may inhibit urine captured by privacy flap 60 from seeping upward into main portion 30.

Referring still further to FIG. 3, bath cover 20 is further shown as generally comprising portions intended to cover the sides of the torso of the child. Such portions, shown as a left side extension 70 and a right side extension 72, are supported at left and right sides of main portion 30 respectively. According to the embodiment illustrated, left side extension 70 and right side extension 72 are integrally formed with main portion 30 to provide a one-piece unitary cover. According to various alternative embodiments, left side extension 70 and right side extension 72 may be formed as a separate components and subsequently coupled to main portion 30.

Left side extension 70 and right side extension 72 are configured to drape over or wrap around the sides of the child to further warm or otherwise comfort the child during the bath process.

The size and shape of left side extension 70 and right side extension 72 can vary depending on various design criteria. According to the embodiment illustrated, left side extension 70 and right side extension 72 are convex portions outwardly extending from left and right sides of main portion 30 respectfully. Left side extension 70 is defined by a peripheral edge 74 having a slight radius of curvature, while right side extension 72 is defined by a peripheral edge 76 having a similar radius of curvature. According to various alternative embodiments, left side extension 70 and right side extension 72 may have any of a number of suitable sizes and shapes having linear edges, non-linear edges, and/or combinations thereof.

According to an exemplary embodiment, left side extension 70 and right side extension 72 are formed of the same material as main portion 30. According to various alternative embodiments, left side extension 70 and right side extension 72 may be formed of or at least include a different material than main portion 30. The bath cover 20 can include a narrowed portion 78 disposed between the pair of side portions (i.e., the left side extension 70 and the right side extension 72) and the first and second support portions (i.e., the first support leg 50 and the second support leg 52), in accordance with various embodiments.

As indicated above in various portions of this disclosure, and as shown in embodiment illustrated, main portion 30 is integrally formed with first and second support legs 50, 52, privacy flap 60, and left and right side extensions 70, 72 to form a unitary one-piece cover. As such each feature is formed of the same material. A single piece of material may be used to create bath cover 20, but preferably multiple pieces of material are used to create bath cover 20. The use of multiple pieces may provide increased softness and comfort for the child. If more than one piece of material (e.g., fabric panel, etc.) is utilized to provide for bath towel, the plurality of materials may be coupled to each other using any known or otherwise suitable technique. For example, the materials may be coupled using mechanical fasteners, adhesives, thermal bonding, stitching, etc.

Figure 5:
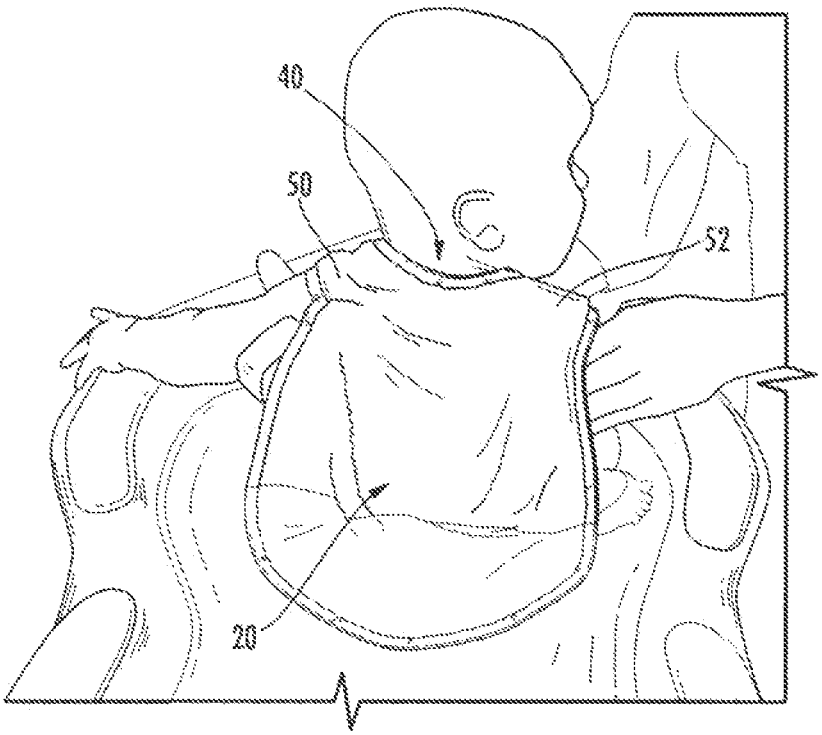
FIG. 5 is a perspective view of the bath cover illustrated in FIG. 1 shown being used on a different portion of the child.

The overall dimensions of bath cover 20 can vary. Bath cover 20 can be sized to substantially cover a specific portion of the body upon which bath towel is placed or otherwise disposed over. According to an exemplary embodiment, bath cover 20 is sized to cover the torso of a child ranging in age from 0 months to 18 months and has an overall length ranging between approximately 10 inches to approximately 24 inches and an overall width ranging between approximately 8 inches to approximately 15 inches. For purposes of the present disclosure, the term "torso" is used broadly to refer to not only the front portion of a child, but also a back portion of child. For example, FIG. 5 shows bath cover 20 placed over the back of a child who is in a seated position.

According to various alternative embodiments, bath cover 20 may have a length and/or width sized larger or smaller than the aforementioned ranges. For example, bath cover 20 may be configured to cover a portion of a child other than or in addition to the torso of the child (e.g., the head, extremities, etc.). According to a further example, bath cover 20 may be configured to cover an adolescent or an adult and therefore have an enlarged length and/or width.

Figure 6:
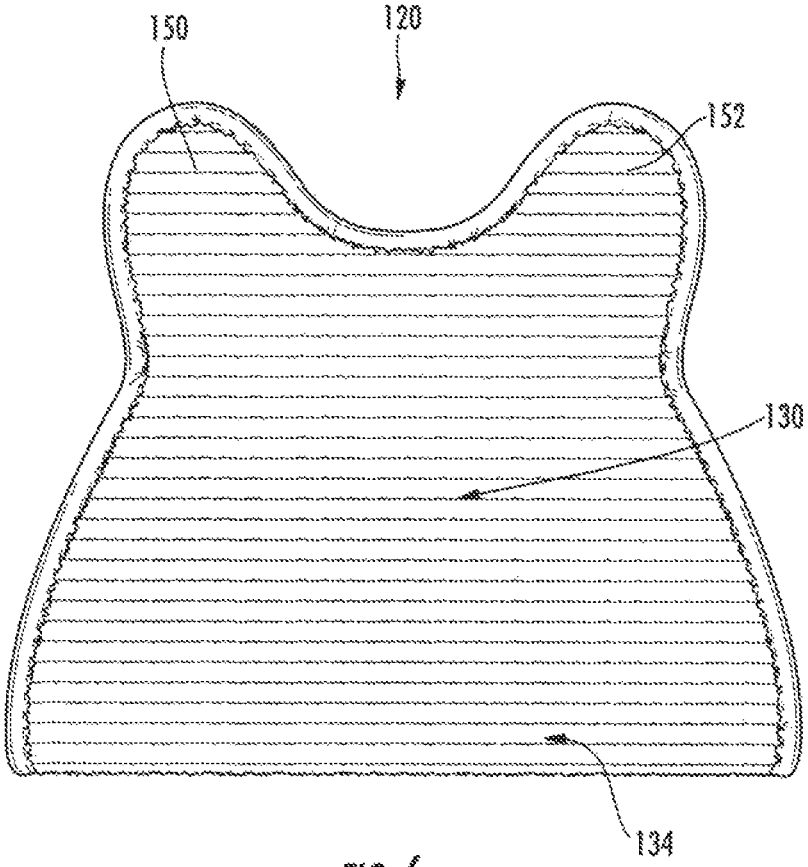
FIG. 6 top view of a bath cover according to another exemplary embodiment.

Referring to FIG. 6, a bath cover is shown according to another exemplary embodiment. For brevity, the description of the bath cover, shown as a bath towel 120, will be generally limited to its differences relative to bath cover 20 described above. For convenience, elements of bath towel 120 that are substantially similar to corresponding elements of bath cover 20 will be identified by the same reference numerals but preceded by a "1".

According to the exemplary embodiment illustrated in FIG. 6, bath towel 120 is provided without privacy flap 60 along bottom region 134 of main portion 130. Such a configuration may be particularly applicable for situations in which the child being bath is sitting generally upright in a bath tub and bath towel 120 is applied to the back torso portions of the child to warm or otherwise comfort the child (as shown in FIG. 5). Such a configuration may also be used to cover the chest or abdominal area of the child in the event that the child is laying down. Further, in such an embodiment, the length of main portion 130 may be extended to cover a lower portion of the child (e.g., legs, etc.).

Figure 7:
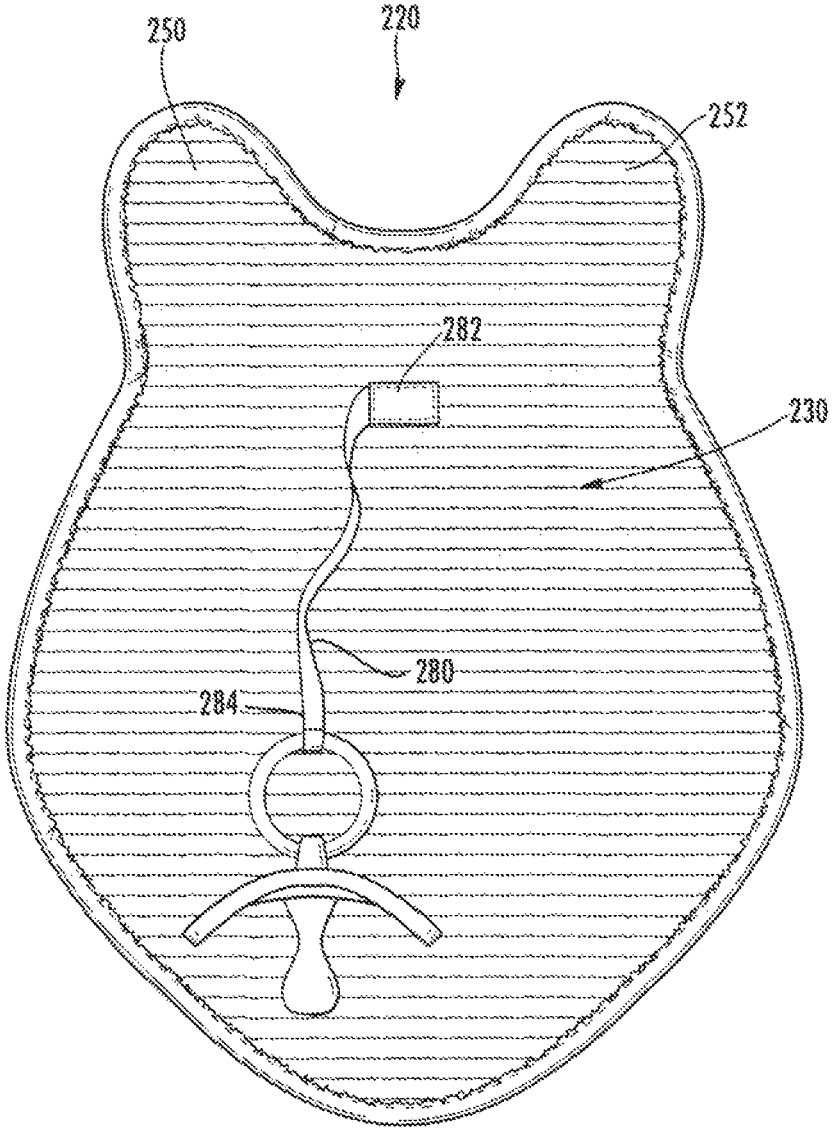
FIG. 7 is a perspective view of a bath cover according to another exemplary embodiment.

Referring to FIG. 7, a bath cover is shown according to another exemplary embodiment. For brevity, the description of the bath cover, shown as a bath towel 220, will be generally limited to its differences relative to bath cover 20 described above. For convenience, elements of bath towel 220 that are substantially similar to corresponding elements of bath cover 20 will be identified by the same reference numerals but preceded by a "2".

According to the exemplary embodiment illustrated in FIG. 7, bath towel 220 further includes an auxiliary or supplemental member (e.g., cord, string, leash, etc.), shown as a strap 280. Strap 280 has a first end 282 coupled to bath towel 220 and a second end 284 that is free. First end 282 may be coupled at any of a variety of locations on bath towel 220 (e.g., main portion 230, first or second support legs 250, 252, etc.). According to the embodiment illustrated, first end 282 is stitched to main portion 230 to fixedly couple strap 280 thereto. According to various alternative embodiments, strap 280 may be fixedly coupled to main portion 230 using any of a variety of known or otherwise suitable techniques. According to further alternative embodiments, strap 280 may be releasably coupled to main portion 230.

Second end 284 is configured to receive a device that may assist in further comforting the child during the bathing process. For example, second end 284 may be configured to receive a pacifier that can be inserted into the mouth of the child if the child begins to whine or fuss during the bathing process or a small toy (e.g., rattle, etc.) that can entertain the child. According to an exemplary embodiment, a pacifier (or any other suitable device) can be releasably coupled to strap 280. Releasably coupling a pacifier to strap 280 allows bath towel 220 to be easily washed since the pacifier can be removed from strap 280 before bath towel 220 is placed into a washing machine. To facilitate the releasable coupling of a pacifier to strap 280, second end 284 may include a fastener, such as a clip, snap, grommet, hook and loop fasteners sold as VELCRO®, or any other suitable fastener.

According to various alternative embodiments, second end 284 may simply include an aperture configured to releasably receive a pacifier (e.g., by being tied with a string, held with a mechanical fastener, etc.).

Figure 8:
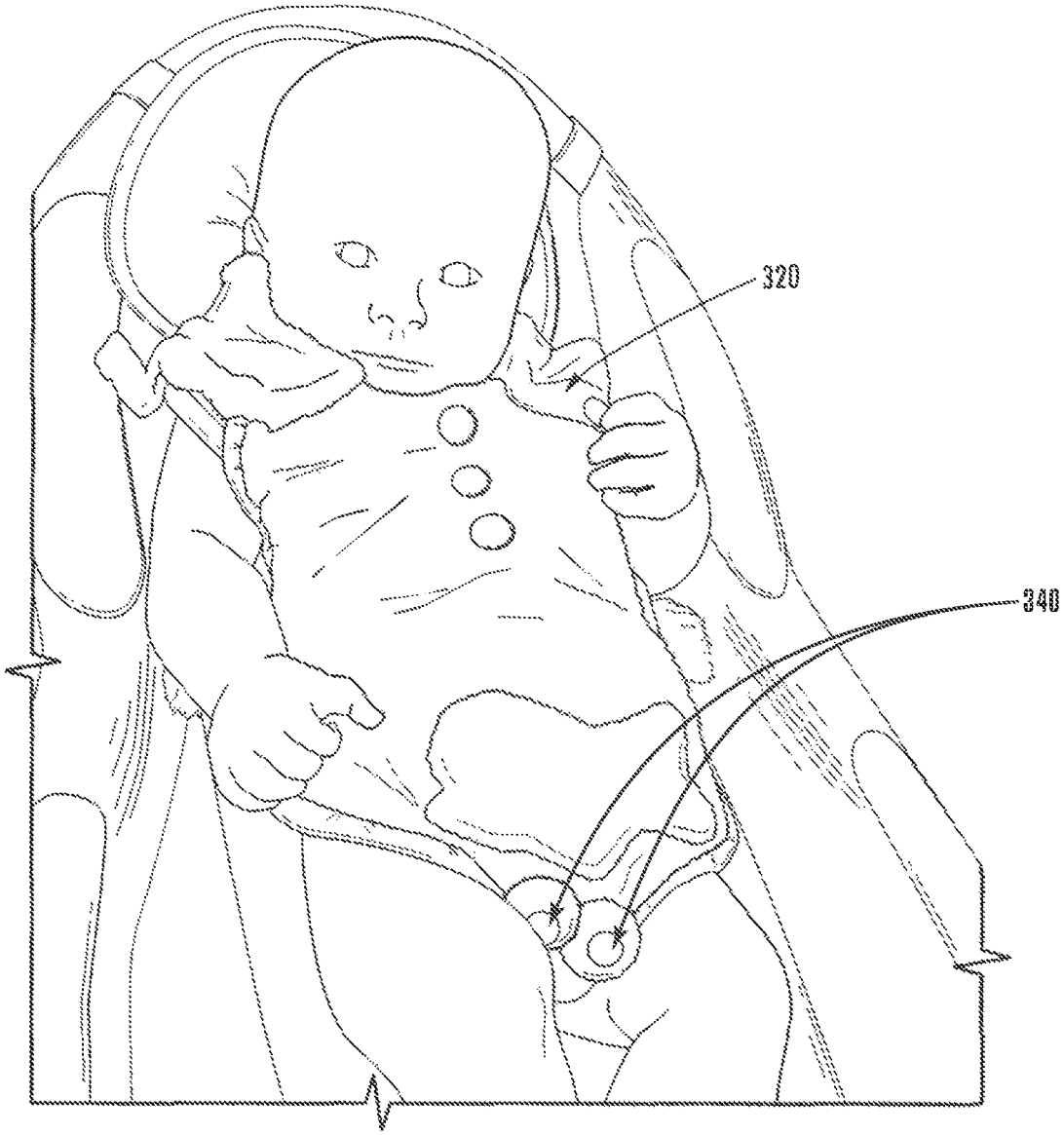
FIG. 8 is a perspective view of a bath cover according to another exemplary embodiment.

Referring to FIG. 8, a bath cover is shown according to another exemplary embodiment. For brevity, the description of the bath cover, shown as a bath towel 320, will be generally limited to its differences relative to bath cover 20 described above. For convenience, elements of bath towel 320 that are substantially similar to corresponding elements of bath cover 20 will be identified by the same reference numerals but preceded by a "3".

According to the exemplary embodiment illustrated in FIG. 8, bath towel 320 is shown as including and/or defining a children's character. For example, bath towel 320 is shown as a frog. Bath towel 320 may be selectively shaped to create various characters (e.g., animals (e.g., bunnies, ducks, fish, etc.), clowns, etc.) or other shapes (e.g., heart-shaped, etc.) that may be enjoyable for the child being bathed. Bath towel 320 may include additional members 340 to further illustrate these characters or shapes (e.g., outwardly extending arms and/or legs, eyes, etc.). According to various alternative embodiments, bath towel 320 may be configured to receive indicia and images on main portion 330 that again may be enjoyable for the child. For example, cartoon characters, team sports logos, and/or wording may be added to bath towel 320 or any of the bath towels disclosed herein. Such indicia and images may be added by any of a variety of suitable techniques, such as screen printing, embroidery and/or heat transfers.

Figure 9:
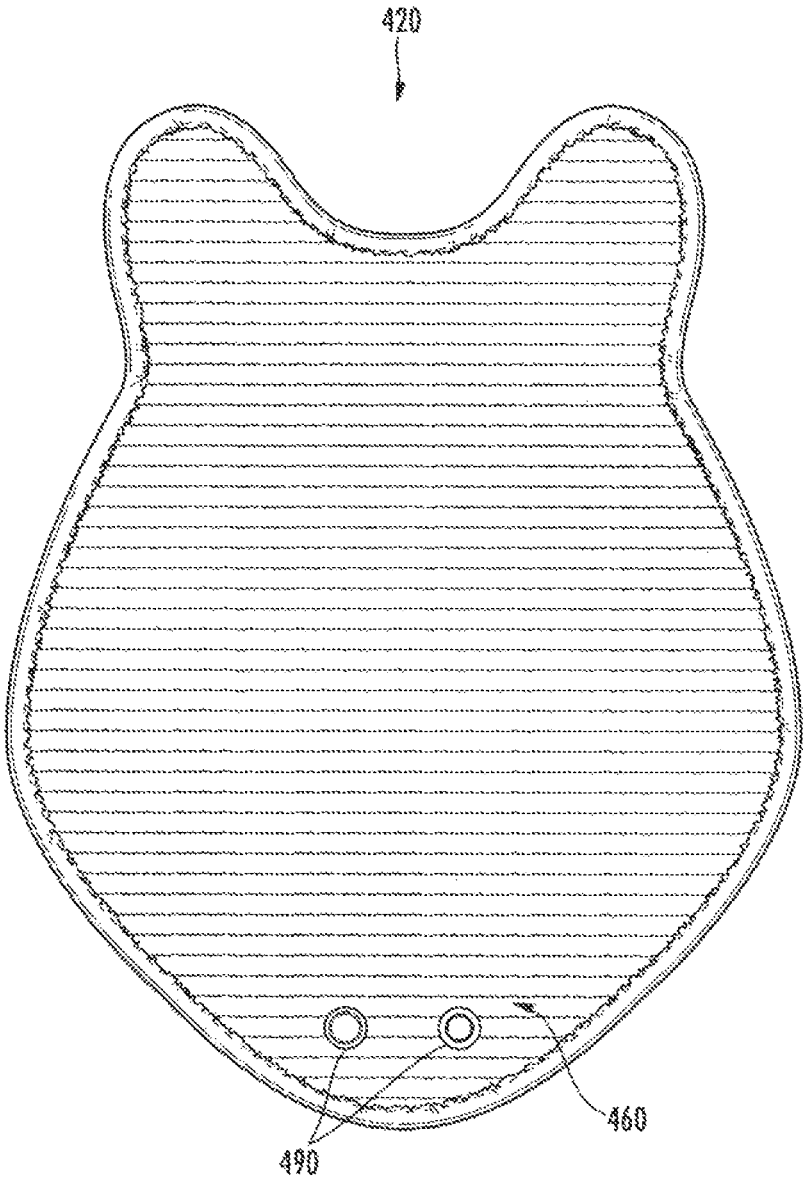
FIG. 9 is a perspective view of a bath cover according to another exemplary embodiment.

Referring to FIG. 9, a bath cover is shown according to another exemplary embodiment. For brevity, the description of the bath cover, shown as a bath towel 420, will be generally limited to its differences relative to bath cover 20 described above. For convenience, elements of bath towel 420 that are substantially similar to corresponding elements of bath cover 20 will be identified by the same reference numerals but preceded by a "4".

According to the exemplary embodiment illustrated in FIG. 9, bath towel 420 further includes a fastening system 490. Fastening system 490 is configured to correspond to a complimentary fastening system on a bath tub or bath tub support device. Fastening system 490 is intended to assist in securing bath 420 relative to a bath tub or a bath tub support device. For example, fastening system 490 may be used to secure bath towel 420 to a hammock or sling supported within a bath tub. Fastening system 490 may take on any of a variety of suitable forms (e.g., snaps, buttons, hook and loop fasteners sold as VELCRO®, clips, etc.). Fastening system 490 may releasably secure bath towel 420 to a bath tub or bath tub support device, or alternatively, may fixedly secure bath towel 420 to a bath tub or bath tub support device. According to an exemplary embodiment, fastening system 490 is a snap supported at privacy flap 460 and is configured to releasably secure bath towel 420 to a bath tub or bath tub support device. A corresponding portion of the snap would be located on the bath tub or bath tub support device. For such a configuration, bath towel 420 may be attached to the bath tub or bath tub support device before the child is placed therein. Bath towel 420 may be supported in a position that is rotated away from the seating area of the bath tub or bath tub support device so that its additional will not interfere with placing the child in the bath tub or bath tub support device. Once the child is placed with the bath tub, bath towel 420 can be rotated about fastening system 490 to a desired position wherein bath towel 420 substantially covers the torso of the child.

According to another exemplary embodiment, the fastening system may be located along a side portion of bath towel 420. For example, bath towel 420 may be coupled at a lateral side portion of a bath tub or bath tub support device (e.g., by being integral therewith, etc.) and configured to be positioned over a child supported therein (e.g., by being pivoted about an area of coupling between bath towel 420 and the bath tub or bath tub support device, etc.). According to another exemplary embodiment, the bath towel 420 may be divided into two or more sections that are each coupled to a bath tub or bath tub support device (e.g., hammock or sling, etc.) and configured to be positioned over a child. For example, bath towel 420 may be divided from top to bottom into two sections (e.g., a right side section and a left side section, etc.). The right side section may be coupled to a first lateral side of the bath tub or bath tub support device, while the left side section may be coupled to a second lateral side of the bath tub or bath tub support device that is opposite the first lateral side. The two sections are configured to substantially cover a child positioned in the hammock or sling by placing the sections over the child (e.g., in a crisscrossed manner, etc.).

A method of using bath cover 20 (or any of the other exemplary embodiments disclosed herein) is described herein with reference to FIG. 1. Prior to using bath cover 20, the parent or caretaker giving the child a bath will partially fill bath tub 10 with a desired amount of water. The child is than placed in bath tub 10 on his or her backside. Typically, a portion of the child will be submersed within the bath water, while another portion of the child is exposed to the ambient air. Often the portion that is exposed to the ambient air is the front of the torso of the child (e.g., chest, abdominal area, etc.) and the gonadic area. To comfort the child, the parent or caretaker positions bath cover 20 over the exposed areas of the child with depression 40 is placed substantially around the neck of the child, first and second support legs 50, 52 placed over the shoulders of the child, main portion 30 placed over the chest of the child, privacy flap 60 placed over the gonadic area of the child, and left and right side extensions draped over the sides of the torso. While gravity may at least partially help maintain bath cover 20 in its desired position, first and second support legs 50, 52 also assist in maintaining bath cover 20 in this position. To further comfort (e.g., warm, etc.) the child, bath cover 20 may be dampened or saturated with relatively warm water (e.g., bath water, etc.). This may be done before bath cover 20 is applied to the child and/or after bath cover 20 is applied. Once the bathing process is completed, bath cover 20 can be removed and the child can be dried with a conventional dry towel. Similar steps can be taken if the child is in a different position (see, e.g., FIG. 5, etc.) or if the bath cover has a different configuration (see, e.g., FIG. 6, etc.).

It is important to note that the construction and arrangement of the elements of the bath cover as shown in the illustrated embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, or the length or width of the structures and/or members or connectors or other elements of the system may be varied. It should be noted that the elements and/or assemblies of the system may be constructed from any of a wide variety of materials that provide sufficient strength or durability, in any of a wide variety of colors, textures and combinations. Accordingly, all such modifications are intended to be included within the scope of the appended claims. Other substitutions, modifications, changes and omissions may be made in the design, operating conditions and arrangement of the preferred and other exemplary embodiments without departing from the spirit of the appended claims. For example, a sound generating device, such as the type used in a squeaky toy, may be added to the bath cover to help entertain the child. Such a device may be added to a main body portion of the bath cover or any other portion.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the appended claims or otherwise inherent from the present disclosure.

Various features of the invention are set forth in the following claims.

What is claimed is:

1. A bath cover for use on a child during a bathing process, the bath cover comprising:

an absorbent body portion made of a machine-washable and reusable material, the absorbent body portion having a first end with a contour corresponding to a neck of the child, the body portion being absorbent through a thickness thereof;

first and second support portions extending outwardly at the first end of the body portion and positionable over shoulders of the child, the first and second support portions are devoid of fastening means for fastening the first and second support portions to one another, and the first support portion comprises a first free end and the second support portion comprises a second free end;

a pair of side portions supported at opposite lateral sides of the body portion and positionable over sides of a torso of the child;

a narrowed portion disposed between the pair of side portions and the first and second support portions; and a gonadic portion supported at a second end of the body portion opposite the first end to cover a gonadic portion of the child when the bath cover is worn;

wherein the pair of side portions is disposed along the body portion between the narrowed portion and the gonadic portion; and the body portion, the side portions, and the gonadic portion are configured to be wetted with a quantity of bath water and positioned in direct contact with a skin of the child to warm the child during the bathing process.

2. The bath cover of claim 1, wherein the body portion, the first and second support portions, and the gonadic portion are integrally formed to provide a unitary bath cover.

3. The bath cover of claim 1, further comprising a fastener for coupling the bath cover to at least one of a bath tub and a bath tub support device during the bathing process, the fastener is disposed on at least one of the second end of the body portion or a first side portion of the pair of side portions, and the fastener comprises at least one of a snap or a hook and loop fastener.

4. The bath cover of claim 1, wherein the first and second support portions comprise a material which is heavier, per unit area, than the machine-washable and reusable material of the body portion.

5. The bath cover of claim 1, wherein the first and second support portions are made of a first material and the body portion is made of a second material that is different from the first material.

6. The bath cover of claim 1, wherein the first and second support portions comprise a friction generating feature including a rubber projection.

7. The bath cover of claim 1, wherein the first and second free ends extend outwardly, with respect to a longitudinal axis of the body portion, from the first end; and the side portions comprise opposing convex portions extending outwardly, with respect to the longitudinal axis of the body portion, from the body portion.

8. The bath cover of claim 1, wherein the gonadic portion has a peripheral edge that is positionable between inner legs of the child, the profile of the peripheral edge is different from that of the contour of the first end.

9. The bath cover of claim 1, wherein a first width of the bath cover at the pair of side portions is greater than a second width of the bath cover at the first and second support portions, the second width is measured from a first lateral side of the bath cover to an opposing, second lateral side of the bath cover at the first and second support portions.

10. The bath cover of claim 1, further comprising a binding disposed around a perimeter of the absorbent body portion.

11. The bath cover of claim 1, wherein the absorbent body portion includes a first panel, a second panel overlaying the first panel, and a binding disposed around a perimeter of the first panel and the second panel.

12. The bath cover of claim 1, wherein, when placed upon the child during the bathing process, the absorbent body portion includes a front surface configured only to face away from the child and a rear surface configured only to be placed against a skin of the child.

13. The bath cover of claim 12, further comprising two additional members disposed on the front surface of the absorbent body portion that form eyes.

14. The bath cover of claim 1, wherein the first and second support portions diverge.

15. The bath cover of claim 1, wherein the first free end is configured to rest on a first shoulder of the child during the bathing process and the second free end is configured to rest on a second shoulder of the child during the bathing process.

16. The bath cover of claim 1, wherein the absorbent body portion is made of a chenille material, a flannel material, and/or a terry cloth material.

17. A bath cover for use on a child during a bathing process, the bath cover comprising:

an absorbent body portion made of a machine-washable and reusable material, the absorbent body portion having a first end with a contour corresponding to a neck of the child, the body portion being absorbent through a thickness thereof;

first and second support portions extending outwardly at the first end of the body portion and positionable over shoulders of the child, the first and second support portions are devoid of fastening means for fastening the first and second support portions to one another, the first support portion comprising a first free end, the second support portion comprising a second free end, and the first and second support portions each comprising a friction generating feature including a rubber projection;

a pair of side portions supported at opposite lateral sides of the body portion and positionable over sides of a torso of the child;

a narrowed portion disposed between the pair of side portions and the first and second support portions; and a gonadic portion supported at a second end of the body portion to cover a gonadic portion of the child when the bath cover is worn;

wherein the body portion, the side portions, and the gonadic portion are configured to be wetted with a quantity of bath water and positioned in direct contact with a skin of the child to warm the child during the bathing process.

18. A bath cover for use on a child during a bathing process, the bath cover comprising:

an absorbent body portion made of a machine-washable and reusable material, the absorbent body portion having a first end with a contour corresponding to a neck of the child, the body portion being absorbent through a thickness thereof, and the absorbent body portion including a first panel, a second panel overlaying the first panel, and a binding disposed around a perimeter of the first panel and the second panel;

first and second support portions extending outwardly at the first end of the body portion and positionable over shoulders of the child, the first and second support portions are devoid of fastening means for fastening the first and second support portions to one another, the first support portion comprising a first free end, and the second support portion comprising a second free end;

a pair of side portions supported at opposite lateral sides of the body portion and positionable over sides of a torso of the child;

a narrowed portion disposed between the pair of side portions and the first and second support portions; and a gonadic portion supported at a second end of the body portion to cover a gonadic portion of the child when the bath cover is worn;

wherein the body portion, the side portions, and the gonadic portion are configured to be wetted with a quantity of bath water and positioned in direct contact with a skin of the child to warm the child during the bathing process.

* * * * *